US009358670B2

(12) United States Patent
Kolthoff

(10) Patent No.: US 9,358,670 B2
(45) Date of Patent: Jun. 7, 2016

(54) TOOL FOR FINE MACHINING OF SURFACES

(71) Applicant: Kolthoff & Co., Flüelen (CH)

(72) Inventor: Dieter Kolthoff, Flüelen (CH)

(73) Assignee: Kolthoff Gabrovo EOOD, Gabrovo (BG)

( * ) Notice: Subject to any disclaimer, the term of this patent is extended or adjusted under 35 U.S.C. 154(b) by 7 days.

(21) Appl. No.: 14/609,459

(22) Filed: Jan. 30, 2015

(65) Prior Publication Data

US 2015/0209938 A1 Jul. 30, 2015

(30) Foreign Application Priority Data

Jan. 30, 2014 (DE) ..... 20 2014 000 852 U

(51) Int. Cl.

| | |
|---|---|
| ***B24D 9/00*** | (2006.01) |
| ***B24D 15/04*** | (2006.01) |
| ***B24D 13/16*** | (2006.01) |
| ***B24D 9/08*** | (2006.01) |
| ***B24D 13/20*** | (2006.01) |
| ***B24D 15/00*** | (2006.01) |
| ***B24D 13/14*** | (2006.01) |
| ***B24D 15/02*** | (2006.01) |

(52) U.S. Cl.

CPC ..... *B24D 9/08* (2013.01); *B24D 13/142* (2013.01); *B24D 13/16* (2013.01); *B24D 13/20* (2013.01); *B24D 15/00* (2013.01); *B24D 15/023* (2013.01)

(58) Field of Classification Search

CPC ..... B24D 9/08; B24D 15/023; B24D 13/142; B24D 9/003; B24D 9/00; B24D 13/16; B24B 15/04

USPC ..... 451/466, 467, 468, 488, 524, 525

See application file for complete search history.

(56) References Cited

U.S. PATENT DOCUMENTS

| | | | | |
|---|---|---|---|---|
| 2,328,886 A * | 9/1943 | Andrews | ..... | A45D 26/0004 451/491 |
| 2,423,992 A * | 7/1947 | Nordgren | ..... | B24D 13/06 451/466 |
| 3,132,452 A * | 5/1964 | Block | ..... | B24D 9/003 451/461 |
| 3,512,311 A * | 5/1970 | Block | ..... | B24D 13/06 451/468 |

(Continued)

FOREIGN PATENT DOCUMENTS

| | | |
|---|---|---|
| DE | 24 11 749 A1 | 9/1975 |
| DE | 198 09 046 A1 | 9/1999 |

(Continued)

*Primary Examiner* — Robert Rose
(74) *Attorney, Agent, or Firm* — Gudrun E. Huckett

(57) ABSTRACT

A surface fine machining tool has a working medium carrier with a bottom side and a top side. Grooves extend from the top side to the bottom side completely through the working medium carrier and have a narrowed portion at the bottom side but do not narrow upwardly toward the top side. The working medium carrier is an injection-molded plastic part. Lamellas with a holding rim and a lamella body are inserted with the holding rim in the grooves. The lamella body extends downward away from the holding rim, passes through the narrowed portion, and extends away from the bottom side. The lamellas are uniformly distributed about the bottom side. The grooves have an open end at a carrier rim of the working medium carrier. The open end has a cross-section matching the groove cross-section. A cover is connected to the top side and covers grooves and holding rims.

15 Claims, 8 Drawing Sheets

(56) References Cited

U.S. PATENT DOCUMENTS 4,251,958 A * 2/1981 Langenberg ..... B24D 9/003 451/467
4,461,127 A * 7/1984 Hanger ..... B24D 13/16 15/180
4,493,170 A * 1/1985 Hanger ..... B24D 9/003 451/463
8,469,775 B2 * 6/2013 Dow ..... B24D 15/023 451/344
2009/0221212 A1 9/2009 Palushaj

FOREIGN PATENT DOCUMENTS

EP 1 633 530 B1 3/2006
WO 2012/163357 A1 12/2012

* cited by examiner

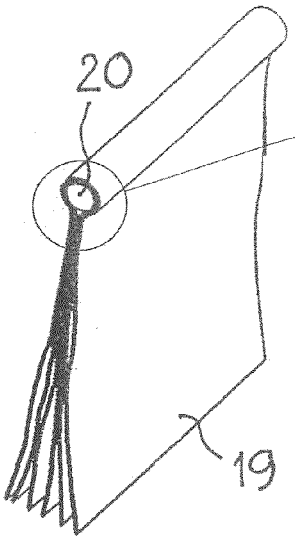
Fig.2
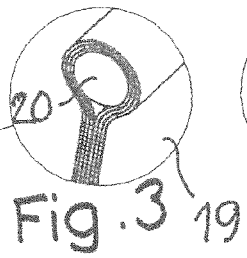
Fig.3
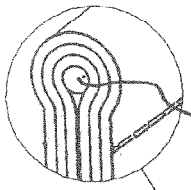
Fig.5
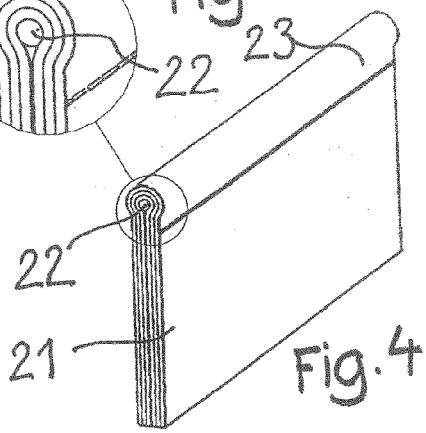
Fig.4
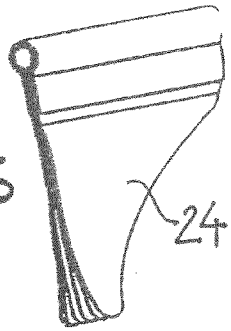
Fig.6
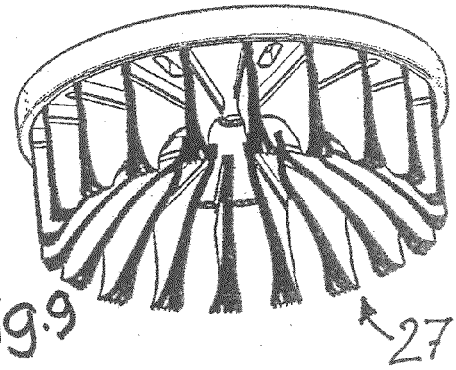
Fig.9
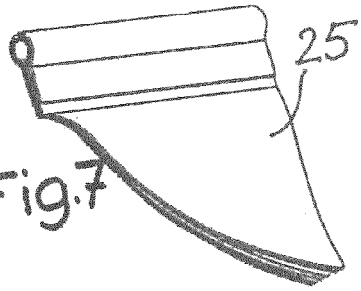
Fig.7
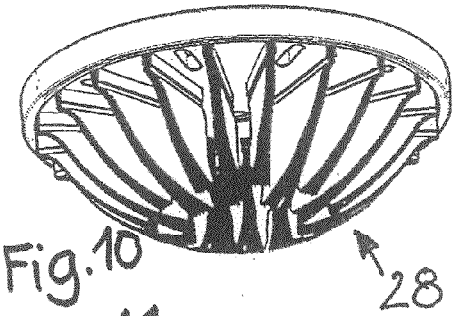
Fig.10
Fig.8
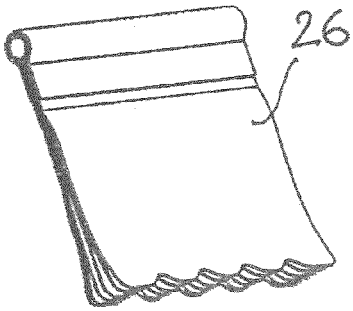
Fig.11
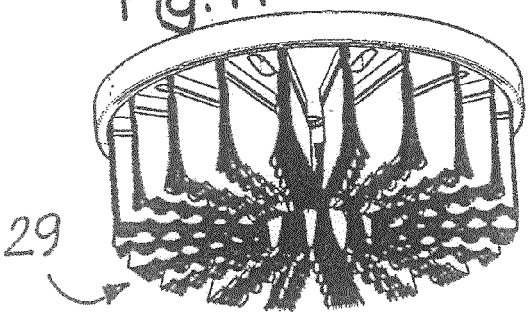

31

37
36
38
33

35
34

38
32

TOOL FOR FINE MACHINING OF SURFACES

BACKGROUND OF THE INVENTION

The invention relates to a tool for fine machining of surfaces in the form of a grinding disk, polishing disk or the like that comprises a bottom side which is furnished with lamellas and is to be placed with this bottom side flat onto a workpiece and is to be used with areal working movements. Such tools can be designed for actuation by hand as well as, with appropriate drive connectors, for machine-based actuation, wherein the machine-based actuation in most cases provides a rotation about an axis that is substantially perpendicular to the bottom side of the tool and, more rarely, provides an eccentric or an oscillating transitory movement. The use of lamellas as working medium enables providing significantly larger working medium quantities in comparison to abrasive sheets (e.g. sand paper) or similar working media, and thus also a longer service life of the tool, and provides in conjunction with the effective lamella width below the bottom side a volume in which abraded or worn material can be stored and that also enables in regard to surface fine machining an adaption to wavy or curved surfaces.

Tools of the aforementioned kind are, for example, disclosed in WO 2012/163357 A1 or EP 1 633 530 A in which lamellas are inserted into grooves provided at the bottom side of the working medium carrier that is closed at the top and, for example, are secured thereat by gluing or embedding (potting). A manufacture of this type is little suited for mass production in great numbers and requires a plurality of different manufacturing and assembly steps.

In view of this, it is the object of the present invention to provide a tool that can be manufactured inexpensively as a mass-produced article and that can be furnished easily and simply with lamellas for different requirements and that also enables the user to carry out retrofitting or renewing with exchange of worn lamellas.

SUMMARY OF THE INVENTION

According to the invention, this object is solved with a tool for fine machining of surfaces, such as cleaning, grinding or polishing, the tool comprising a working medium carrier whose bottom side is provided with a set of lamellas that are arranged in uniform distribution and oriented primarily downwardly, the lamellas each extending with an upper holding rim that in cross-section is reinforced in grooves of the working medium carrier, wherein the grooves are narrowed toward the bottom side of the working medium carrier and allow the respective lamella to pass through with the exception of the holding rim, and wherein the grooves, at least with one end, exit with an open groove cross-section from the working medium carrier at a carrier rim of the working medium carrier, wherein the working medium carrier is comprised of an injection-molded plastic part in which the grooves are formed so as to be open at the top without being narrowed in upward direction and at the top are covered by a cover that is fixedly connected to the working medium carrier and that closes off the grooves with the lamellas inserted therein.

With such a tool, in which the working medium carrier is comprised of a monolithic injection-molded plastic part that secures the lamellas in grooves that open toward the bottom side in a narrowed configuration, a constructive key component for the entire tool is provided. The grooves that are open at the top without being narrowed enable configurations of the injection-molding tool) mold) with simple constructive shapes and simple opening action in order to design the injection molding process and in particular removal from the mold to be quick and reliable. At the same time, the lamellas are held in the grooves at several sides. The cover closes off the grooves at the top, secures the lamella captively in the grooves, and covers also the top side of the tool carrier so that a guard against contact is provided when the tool is rotating or oscillating, the surface can be designed to be pleasing and little prone to soiling, and, for example, in hand-actuated tools, grip areas on the cover can be formed and embodied.

Preferably, the cover, interacting with the working medium carrier, is designed such that with its bottom face it is engaging the lamellas or the holding rim and fixes or clamps the lamellas in the groove and, in particular, also secures them frictionally or with form fit against longitudinal sliding in the groove. Moreover, a cover is suited to form channels for an air guiding action of exhaust air together with the working medium carrier, wherein the channels open approximately between the lamellas at the bottom side of the working medium carrier and are guided outward with connecting openings at the top face of the cover, provided so as to approximately match the suction connectors in standard configurations of drive machines.

The cover that itself can also be of a multi-part configuration and can be comprised of one or several annular elements, for example, in case of a rotating tool, must regularly be connected fixedly with the working medium carrier for working with the tool. This does not preclude a detachable connection of the cover, or part of the cover, relative to the working medium carrier and also does not cause a significant manufacturing expenditure or a complex configuration of the tool. The connection between cover and working medium carrier can be realized simply by screw connections or by clamps; likewise, locking or latching devices can be provided. In case of tools that are configured with rotational symmetry, for example, for use on rotating drives such as power drills, formed thread parts, bayonet connections or similar complementary connection pairs can be formed already during injection molding and can be coupled with a simple rotation or turning action, wherein the rotation direction preferably corresponds to that occurring during working loads in order to prevent decoupling when a working load is acting. A detachable connection may provide the user with the possibility of exchanging lamellas as a whole or partially when worn or for adaptation to the work to be performed.

On the other hand, the cover can be connected simply and in a robust way non-detachably with the working medium carrier to form a "disposable tool", for example, by gluing or fusing in case of selecting matching thermoplastic materials of injection molding materials for the cover and the working medium carrier. In any case, the configuration according to the invention of the tool provides for variable furnishing during manufacture with advantages for simple working steps in mass production.

For tools of this kind that are to be actuated by a machine, a drive connector is to be provided that is suitable for the driving action and is expediently fixedly connected to the working medium carrier itself and thus enables a robust and direct introduction of the driving forces while the cover remains free of loads and accordingly can be designed to be lightweight.

For manually actuated tools of this kind on the other hand, advantageously a cover in the form of a cap that comprises a closed top and is provided with a gripping area can be provided, wherein a grip like a hand knob can be provided for gripping or the grip can be designed for flat pressure action by a hand with a hand loop though which the hand is to be pushed.

BRIEF DESCRIPTION OF THE DRAWING

Embodiments of the invention are illustrated in the drawing and will be explained in the following in more detail.

FIG. 2 shows a lamella for a tool according to FIG. 1.

FIG. 3 shows an enlarged detail of FIG. 2.

FIG. 4 shows a view of a further lamella of a tool according to FIG. 1.

FIG. 5 shows an enlarged detail of FIG. 4.

FIGS. 6, 7, 8 show various lamellas with a particular contour of the bottom edge, respectively.

FIGS. 9, 10, 11 show views of the lamellas according to FIGS. 6, 7, 8, respectively, inserted into a tool according to FIG. 1.

FIG. 17 shows a detail view of the area of FIG. 16 marked with a circle.

DESCRIPTION OF THE PREFERRED EMBODIMENTS

Figure 1:
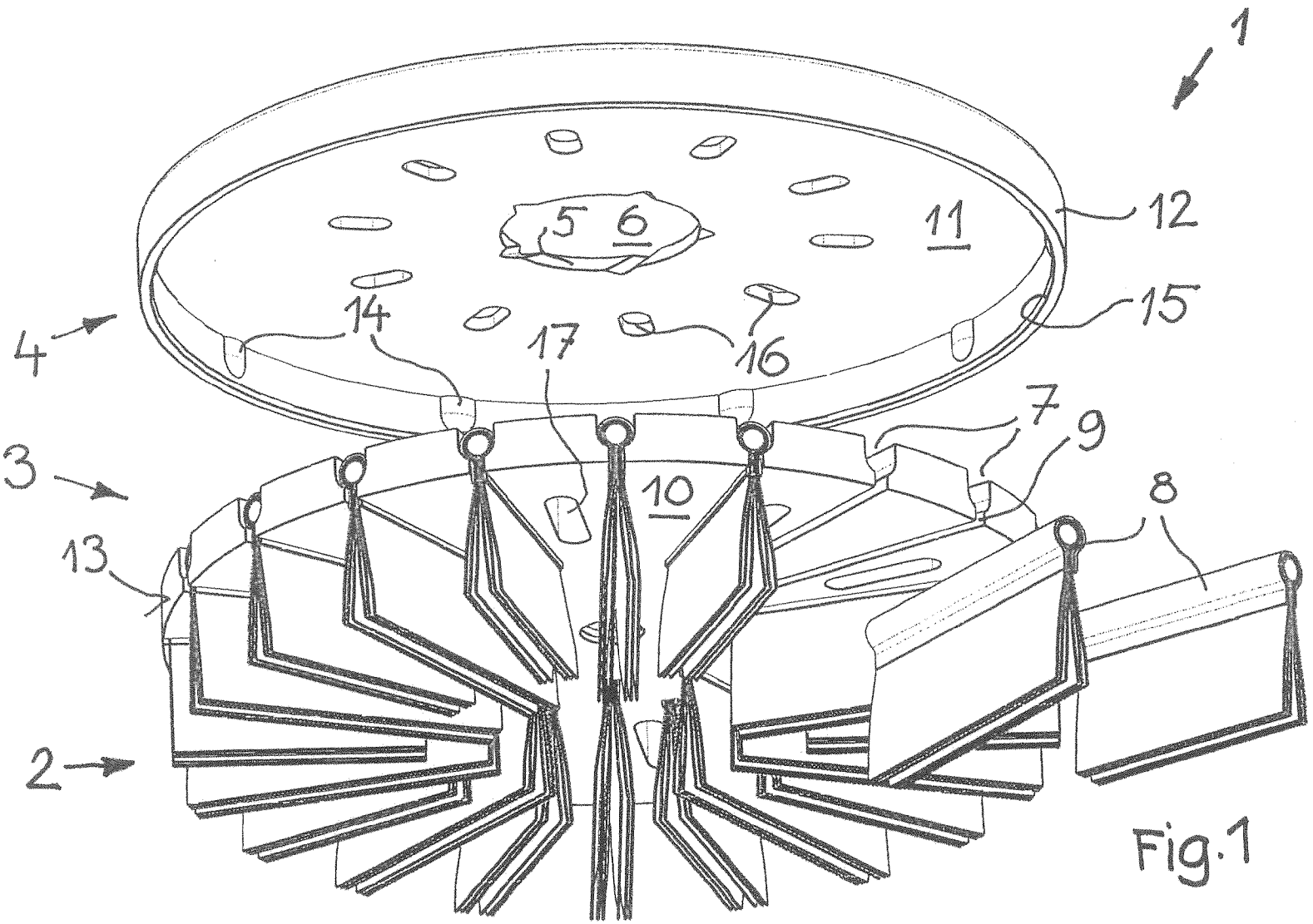
FIG. 1 shows a view of a tool in exploded illustration in a perspective view from below.
Figures 12, 13, 14, 15:
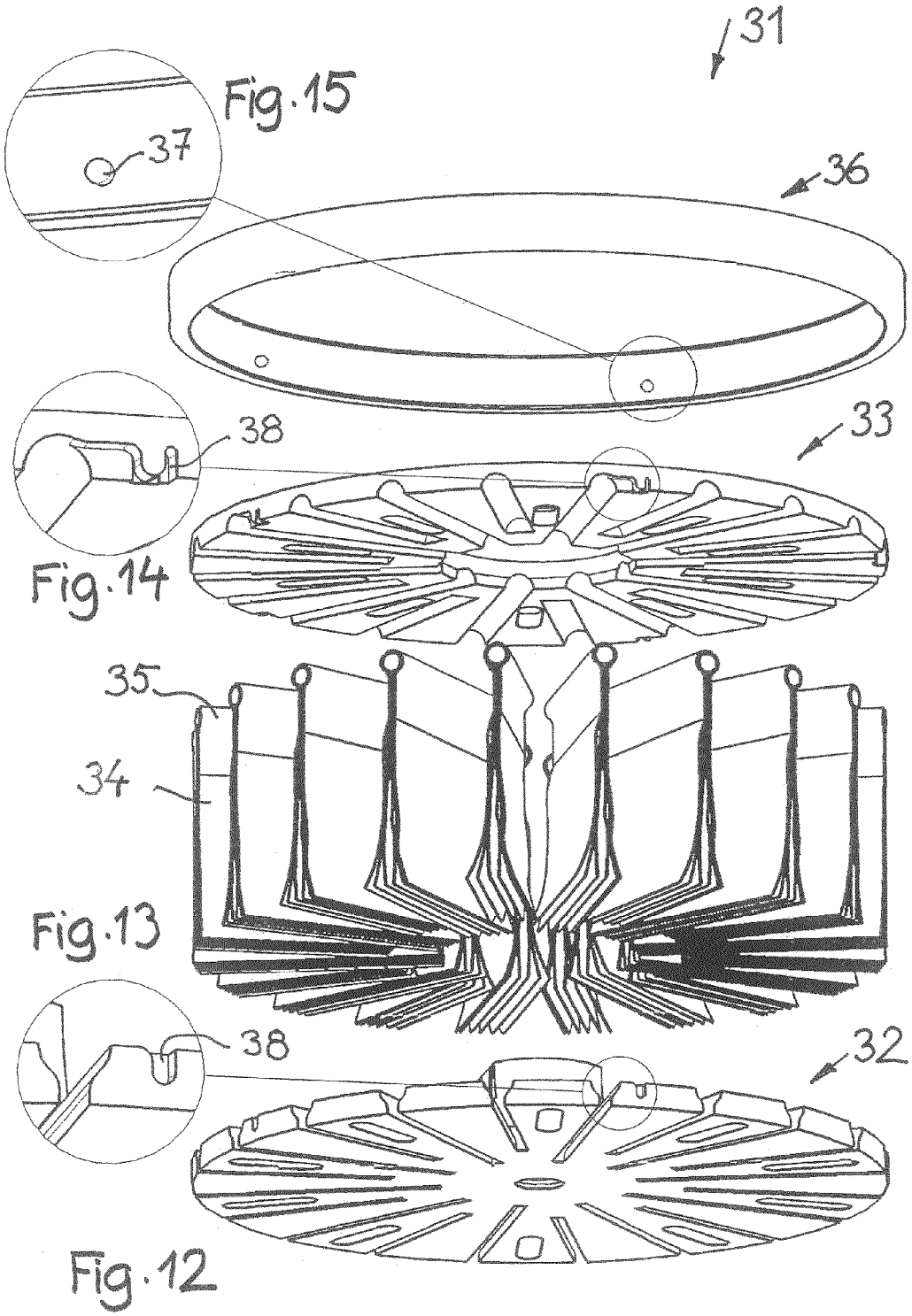
FIG. 12 is an exploded view of another tool according to the invention in a perspective view from below.
FIGS. 13, 14, 15 show detail views of areas of FIG. 12 that are marked with a circle, respectively.

The tool that is identified in FIG. 1 with reference numeral 1 for fine machining of surfaces, such as cleaning, grinding or polishing, by means of lamellas 2 projecting from the bottom side and provided with suitable working media is configured rotation-symmetrical relative to a vertical center axis. It comprises a working medium carrier 3 and a cover 4 that can be fixedly and with sufficient operational safety connected to each other by integrally formed threaded portions. One formed threaded portion 5 on a central opening 6 of the cover 4 engages matching outer threaded sections on a socket-shaped drive connector (not illustrated) that passes through the opening 6. The drive connector is connected monolithically with the working medium carrier 3 and projects at the center away from the carrier 3 in upward direction. Basically similar configurations of such a drive connector will be illustrated in the following with the aid of FIGS. 16 and 18.

The integrally formed threaded portions such as the threaded portion 5 in FIG. 1 are however only one example of many connecting possibilities suitable in practice between cover and working medium carrier; for example, they can also be designed to be of a bayonet-type configuration but also can be provided on the periphery of the working medium carrier 3 and of the cover 4. In order to provide a detachable connection, there is additionally the possibility to provide the connection between cover 4 and working medium carrier 3 by screw connections, which, for example, can be provided on a screw connection circle, or by clamps, which optionally can be relieved also by profiling or toothing engagements between cover 4 and working medium carrier 3 against rotation. When however for the user of the tool detachability of the cover from the working medium carrier during or after use is not of interest, both parts can also be connected permanently to each other upon assembly, for example, by gluing or fusing.

These multiple embodiments can be produced with a working medium carrier 3 and a cover 4 of plastic material quickly, simply, and inexpensively by way of injection molding. The working medium carrier 3 comprises primarily radially oriented grooves 7 for receiving lamellas 2. The groove cross-section is matched to the cross-section of an upper reinforced (thicker than the remainder of the lamella) holding rim 8 of the lamellas 2 wherein the lamellas 2 extend away from the holding rim 8 in downward direction, pass through a narrowed portion 9 of the groove cross-section, and then project away from the bottom side 10 of the working medium carrier 3 with a functionally effective exposed strip.

The grooves 7 open at the carrier rim, i.e., have an open end in the longitudinal direction with a cross-section or shape that matches the groove cross-section, and enable in this way furnishing of the working medium carrier 3 with the strip-shaped lamellas 2 that are reinforced by the holding rim 8 that is thicker than the lamella body (remainder of the lamella). The holding rim 8 of the lamellas 2 can be inserted through the open end from the exterior into the interior in longitudinal direction into the grooves 7.

The grooves 7, due to their manufacture, are formed to be open in upward direction without being narrowed. It is thus possible in particular to avoid complex multi-part injection molds for a working medium carrier 3 with narrowed and thus inaccessible grooves and, instead, to provide a simple mold, preferably comprising only two parts, that can be handled, even for removal of the molded article from the mold, with a simple opening movement quickly, simply, and robustly.

By means of the grooves 7 that are open at the bottom side and the top side and have an open end in longitudinal direction, slots are provided in the working medium carrier 3 and, between the slots, sectors of the working medium carrier 3 are maintained that are connected only in a central area with each other. The grooves 7, as can be seen in FIG. 1 by means of on the bottom edges of the lamellas 2, have different lengths, i.e., alternatingly the grooves are long (first grooves) or short (second grooves), in order to cover the bottom side 10 of the working medium carrier 3 more uniformly with the set of the lamellas 2; still, by means of the grooves 7 a mechanical weakening of the working medium carrier 3 exists. This weakening could be reduced in principle by a connecting ring (not illustrated) at the outer carrier rim which extends above the open ends of the grooves 7 as well as outside of the topside openings of the grooves 7. In the present case, a reinforcement is however provided by means of the cover 4.

The monolithic cover 4 comprises in addition to a substantially flat cover plate 11 a circumferential annular collar 12 which, after the working medium carrier 3 has been furnished with the lamellas 2 and connected with the cover 4, tightly encloses a circumferential carrier rim 13 of the working medium carrier 3. Accordingly, the open ends of the grooves 7 at the carrier rim are closed off so as to prevent the lamellas 2 from being thrown off.

Moreover, the annular collar 12 is provided with locking knobs 14 integrally formed at the inner side that engage the open ends of the grooves 7 and fix the sectors of the working medium carrier 3 relative to each other; at the same time, they also provide a locking restraint in the circumferential direction against a detachment or loosening movement within the connection between working medium carrier 3 and cover 4 when moment loading occurs, for example, during use of the tool. In principle, the rotational direction of the formed threaded portions 5 between cover 4 and working medium carrier 3 is selected such that load moments that occur when using the tool act in the sense of a fixed (fast) connection.

Expediently, the annular collar 12 also comprises a locking rim 15 which is circumferentially extending all around or at least partially with which the annular collar 12 can also engage the working medium carrier 3 from below in order to secure the connection between cover 4 and working medium carrier 3.

The cover 4 has in addition to the central cutout 6 also an annular arrangement of openings that are uniformly distributed in a circle and serve as connecting openings 16 for a dust suction device. For a concentric suction connector of a drive, these opening are to be provided with matching outer diameter, for example. However, the suction guiding action below the cover 4 can then be designed as desired, for example, with open channels in the working medium carrier 3 and closed off by the cover 4 from above, in order to connect with suction openings 17 at the bottom side of the working medium carrier 3 which are positioned between the grooves 7 and the lamellas 2 extending away from the grooves 7. In the configuration of the tool 1 according to FIG. 1, the connecting openings 16 and the father outwardly extending suction openings 17 still overlap each other to such an extent that a direct suction guiding action is provided. Should it be desired to furnish such a tool due to its conditions of use with a suction removal device, the cover 4 thus enables that the suction openings 17 can be adjusted in a simple way properly with regard to working with the tool and the top-side connecting openings 16 in the cover 4 can be placed so as to match the connector provided at the machine.

In FIGS. 2 to 11, examples of differently designed lamellas are illustrated which, in comparison to abrasive sheets for grinding or polishing or similar flat working media, are able to provide greater working medium quantities and also provide intermediate volumes for abraded particles and dirt can also be designed differently. A tool of the kind proposed here is suitable to be furnished with different types of lamellas; however, an adaptation of the upper holding rim of the lamellas to the grooves 7 of the working medium carrier is to be predetermined.

A simple configuration of a lamella 19 according to FIG. 2 provides that three double-wide strips, folded at the center in longitudinal direction, are placed about an inner core 20 with round cross-section and fixed in this position. Accordingly, the lamellas provide a strip shape with reinforced holding rim that is insertable into the tool according to the invention in longitudinal direction.

A variant of a lamella 21 according to FIGS. 4 and 5 has a relatively thin inner core 22 but is reinforced in the area of the reinforced holding rim at the circumference with a welt or bead 23 in order to achieve a shape of the holding rim that can be easily inserted into the groove 7 of the carrier 3 but at the same time has little play relative to the grooves 7.

In FIGS. 6, 7, and 8, various lamellas 24, 25, 26 are illustrated whose bottom edge is not extending simply parallel to the holding rim but is designed in a particular way with a contour in order to achieve, for example, a concave envelope surface 27 in the mounted state according to FIG. 9, or a convex envelope surface 28 according to FIG. 10, or a wavy bottom surface 29 according to FIG. 11. Accordingly, embodiments for certain application situations, such as hollow or spherical shapes, can be fashioned in a targeted way. An embodiment of a tool 31 which is modified relative to the tool 1 according to FIG. 1 can be seen in FIGS. 12 to 15. Reference is being had to the description of the tool 1. The deviations to be emphasized here represent in particular two-way profiled configurations of a working medium carrier 32 and cover 33 that supplement each other, wherein the working medium carrier 32 has grooves past which the lamellas 34 with reinforced holding rims 35 are projecting but, from the top side, are engaged by fitting profilings of the cover 33 in a direction toward the working medium carrier 32 in order to clamp the reinforced holding rims of the lamellas 34 between the working medium carrier 32 and the cover 33.

Moreover, the cover 33 is not monolithic with an annular collar but is engaged and clamped by a circumferential ring 36 together with the working medium carrier 32. A detachability of the holding ring 36 is to be achieved in that it is provided with radially inwardly oriented coupling pins 37 (FIG. 15) which engage movably in circumferential grooves 38 in the cover 33 and in the working medium carrier 32 (FIGS. 13 and 14) in order to obtain a securing connection wherein the grooves 38 are positioned as in a bayonet connection so that the connection is secured against easy detachment or release.

Figure 16:
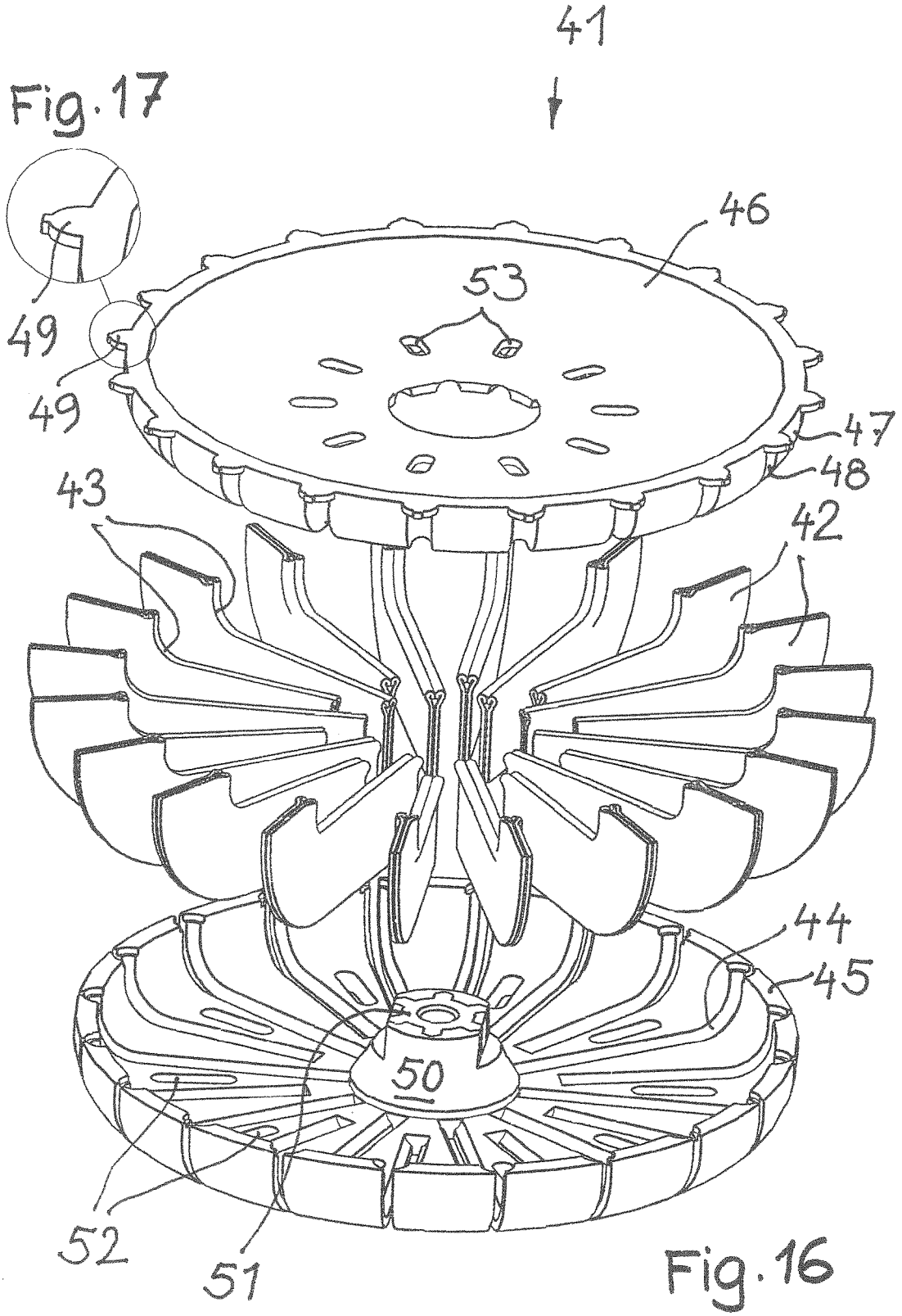
FIG. 16 is an exploded view of a further embodiment of a tool according to the invention in a perspective view from above.

A further tool 41 according to FIGS. 16 and 17 comprises, relative to a bottom side from which the lamellas are projecting through narrowed portions of the groove cross-section, an upwardly curved carrier rim area where the lamella strips 42 that are appropriately shaped with arc-shaped holding rims 43 can also project radially. The grooves 44 in a working medium carrier 45 provided with the bottom side are not straight but are shaped to rise at the exterior.

The cover 46 has a concave bottom side 47 which snugly fits with open groove shapes 48 the holding rims 43 of the lamellas 42 for top-side securing of the holding rims 43 of the lamellas 42.

Outwardly projecting locking shapes 49, illustrated enlarged in FIG. 17, engage the groove cross-sections 44 of the working medium carrier 45 that are open at the end and in this way they stabilize, on the one hand, the working medium carrier 45 and, on the other hand, secure the cover 46 with anti-rotation action relative to the working medium carrier 45. The connection between cover 46 and working medium carrier 45 in axial direction is not illustrated in FIG. 16. It can be achieved, as discussed above, in various ways with known means.

A conventional drive connector 50 in a pin shape is illustrated on the working medium carrier 45 into which, during injection molding, also a metallic cup nut 51 is embedded for greater strength. This drive connector 50 extends through a central opening of the cover 46 so that a force flow from the drive can be transmitted on a short path directly into the working medium carrier 45 while the cover 46 remains free of load.

The working medium carrier 45 has suction slots 52 which open at the bottom side between the lamellas 42 and at the topside are in communication with suction connection slots 53 in the cover 46 in order to provide an air guiding action for the dust suction action wherein the slots 52 and 53 must not be congruent at all. Typically, the slots 52 extend radially farther outwardly than the radially limited slots 53 for the corresponding machine connector.

Figure 18:
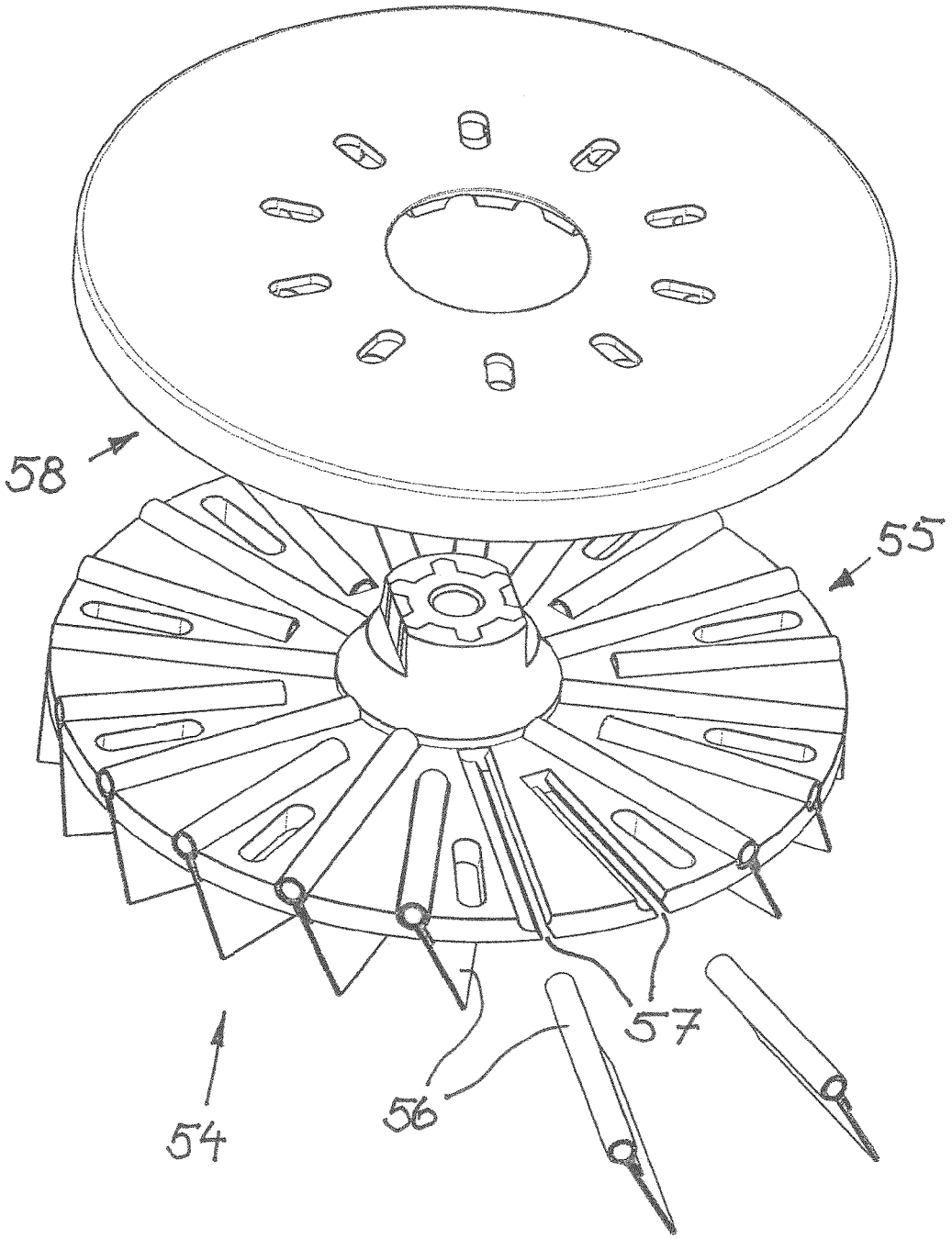
FIG. 18 is an exploded view of a further embodiment of a tool according to the invention in a perspective view from above.

A further embodiment according to FIG. 18 shows a tool 54 according to the invention in which in a working medium carrier 55 of the afore described kind has lamellas 66 that are not oriented perpendicularly downwardly but at a slant. In the present case, the slant is "trailing", i.e., for a rotation of the working medium carrier 55 in clockwise direction, the lamellas 66 are trailing. This facilitates a flat overlapping working position of the lamellas 66. For other application situations, a slanted position of the lamellas opposite to the rotation direction is also conceivable, for example, in order to enable the lamellas to generate bending stress upon polishing or grinding and to obtain in this way a cushioning effect. In any case, the respectively desired slanted position of the grooves 57 can be predetermined and can be stabilized by attaching the cover 58.

Here, the working medium carrier 55 is also provided with a monolithically formed drive connector 59 so that the forces applied by the respective drive or the moments can be transmitted within the working medium carrier 55 onto the lamellas 56 while the cover 58 is thus outside of the force flow.

Figure 19:
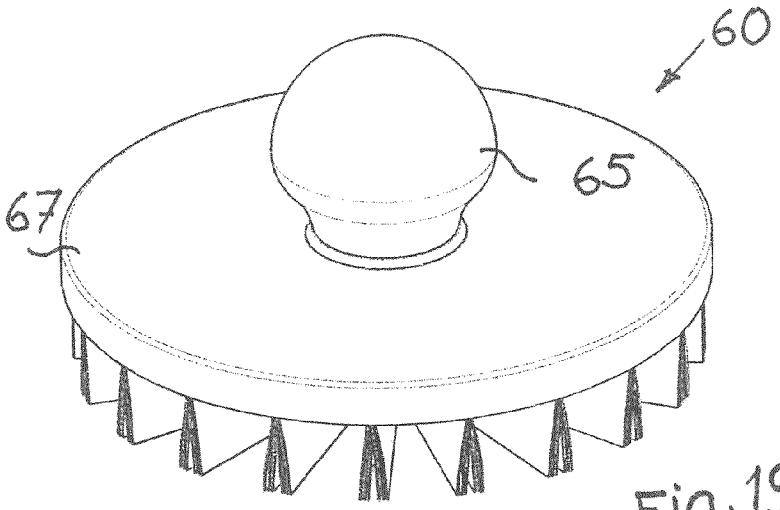
FIG. 19 shows a tool according to the invention in a perspective view from above.
Figure 20:
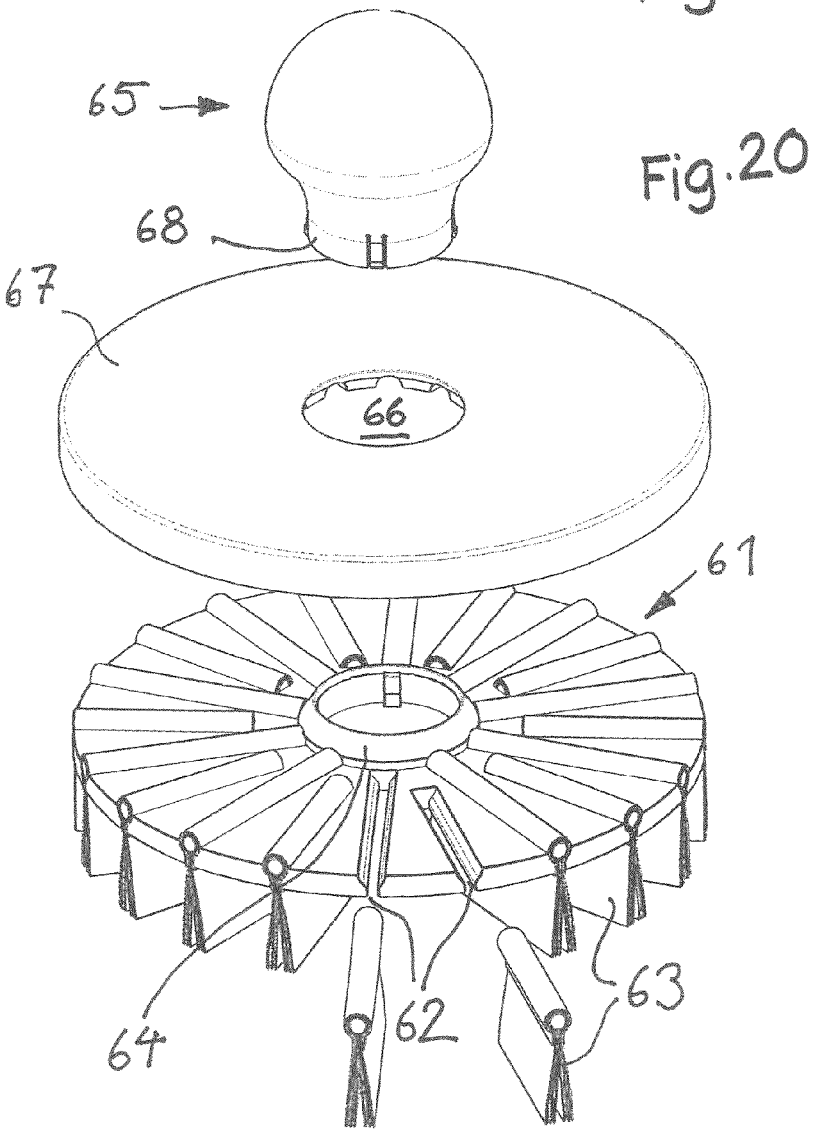
FIG. 20 is an exploded illustration of the tool according to FIG. 19.

In FIGS. 19 and 20, a tool 60 for fine machining of surfaces by hand is illustrated wherein FIG. 20 shows only the exploded view or illustrations of individual parts prior to assembly of the tool. The tool 60 has a working medium carrier 61 of rotation-symmetrical shape with radial grooves 62 for receiving lamellas 63 but is not provided at the center with a drive connector for machine-based actuation but is provided with a coupling ring 64 on which a hand knob 65 can be locked by being pushed through a central opening 66 of the cover 67 with a locking pin 68. The configuration of the working medium carrier 61 and of the cover 67 as well as their adaptation to each other follows the afore described configurations for a machine-operated tool. Also, the force introduction here takes place directly from the hand knob 65 into the working medium carrier 61 by bypassing the cover 67 which is to be designed for covering of the working medium carrier 61 and for securing the lamellas 63 in the grooves 62.

Figure 21:
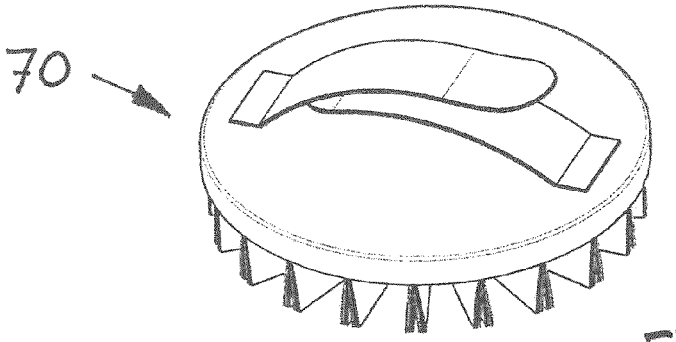
FIG. 21 shows a further tool according to the invention in a perspective view from above.
Figure 22:
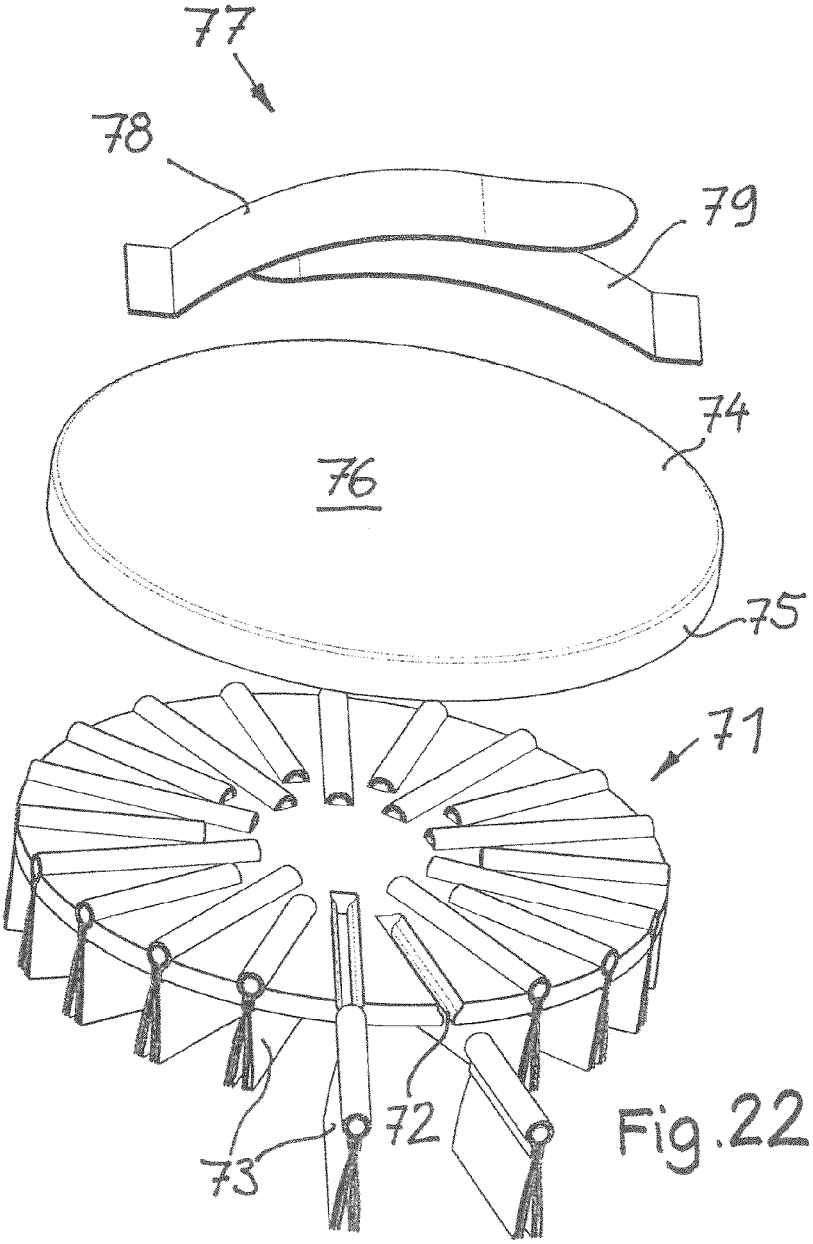
FIG. 22 is an exploded illustration of the tool according to FIG. 21.

A further manually operated tool 70 is illustrated in a perspective view from above in FIG. 21 and in an exploded view in FIG. 22 wherein the configuration of a rotational-symmetrical working medium carrier 71 with grooves 72 for introducing lamellas 73 corresponds to the afore described design guidelines; however, no central force introduction is provided. The working medium carrier 71 is instead fixedly connected to a cover 74 which not only covers the working medium carrier 71 and serves for positional fixation of the lamellas 73 at bottom side (not illustrated) of the working medium carrier 71 and the outwardly engaging annular collar 75, but also is provided with a crowned topside 76 providing a contact surface for the hand for manual actuation. The forces of manual actuation are then primarily introduced into the cover 74 and from the cover 74 introduced by contact locations and connections to the working medium carrier 71 and into the lamellas 73. For ease of manual actuation, at the top side a hand loop 77 is provided which, for example, can be made of plastic material and fused or sealed onto the cover 74 when the cover is comprised of a matching plastic material; the loop 77 can also be screwed on or riveted on. The hand loop 77, for width adjustment, can be comprised of two loop pieces or strips 78, 79 which with spaced-apart ends are to be connected to the cover 74 and with overlapping areas can be secured to each other by hook-and-loop fasteners or other detachable connections.

Figure 23:
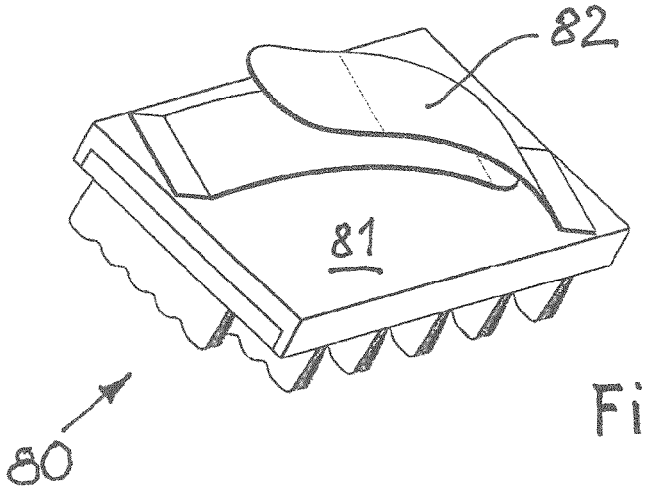
FIG. 23 shows a tool according to the invention in a perspective view from above.
Figure 24:
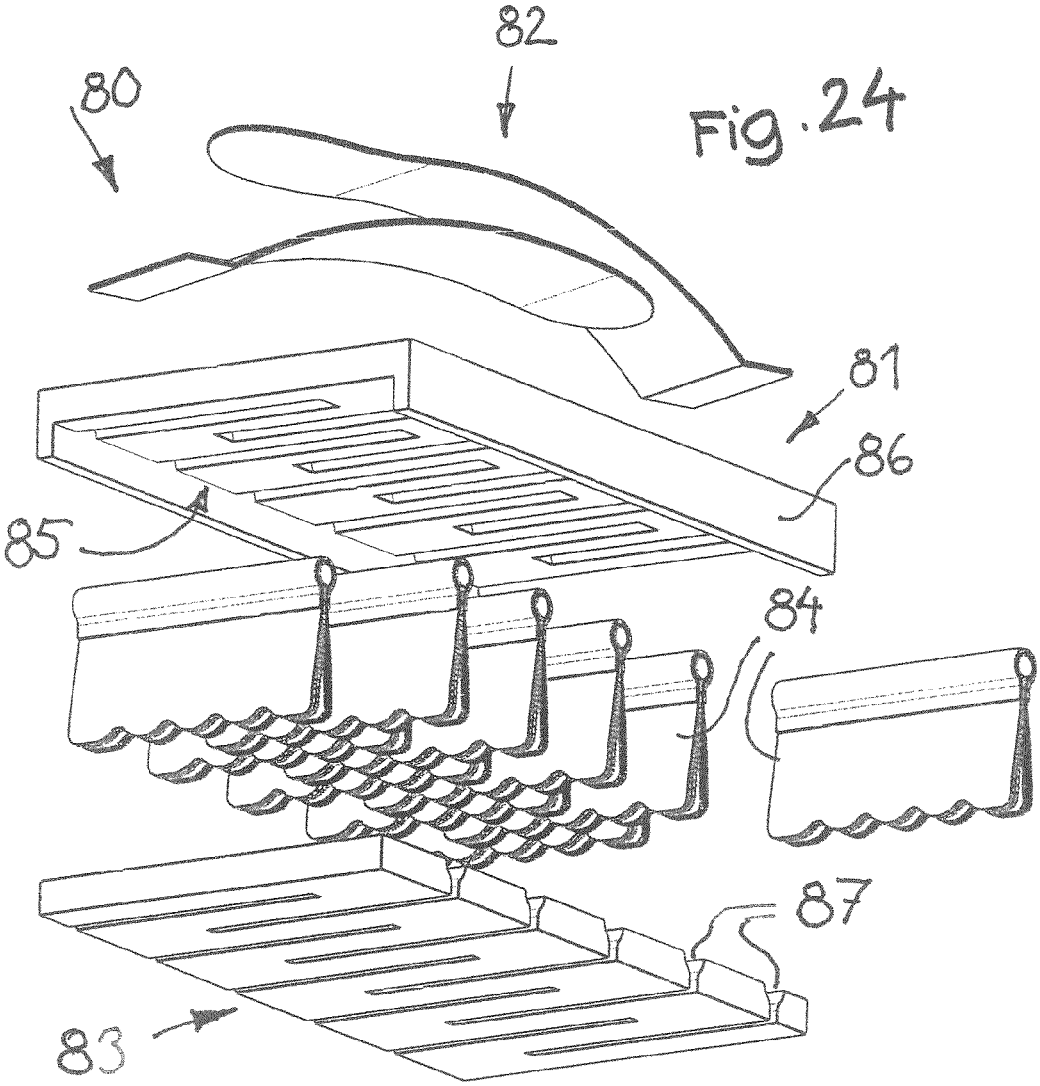
FIG. 24 is an exploded view of the tool according to FIG. 23.

A further manual tool 80 for fine machining of surfaces as shown in perspective view according to FIG. 23 and exploded view according to FIG. 24 is embodied with a rectangular basic shape (instead of the afore considered round basic shapes). Here, the cover 81 also serves as a gripping surface for a hand supported by a hand loop 82 of two loop pieces or strips that are detachable and reconnectable for width adjustment, wherein the hand loop 82 is placed diagonally onto the cover 81. The cover 81 extends across a working medium carrier 83 and engages two opposed longitudinal sides where some of the grooves 87 open for introducing and holding lamellas 84. The lamellas 84 and the grooves 87 are provided as parallel sets wherein they do not extend across the entire width of the working medium carrier 83 but leave an end area unoccupied. Since the grooves in this way are alternatingly extended from the first or the second longitudinal side of the working medium carrier 83 inwardly, the working medium carrier 83 remains a monolithic body. The spacings between the parallel sets of lamellas are provided to be smaller in the central area across the width of the tool 80 than in the carrier rim area toward the longitudinal sides. In this way it is also possible to obtain a weakening at the carrier rim area which, in practice, is desirable for fine machining of surfaces.

The cover 81 has at its bottom side 85 a shape that is designed to engage the top edges (holding rims) of the lamellas in order to secure them within the working medium carrier 83 free of play as much as possible Moreover, the cover 81 engages by means of lateral parts 86, extending in downward direction, longitudinal edges of the working medium carrier 83 in order to close off the edges (carrier rim) smoothly and to positionally fix the inserted lamellas.

It is understood that the afore described round embodiments as well as the rectangular embodiment according to FIGS. 23 and 24 represent only exemplary embodiments of a plurality of design possibilities in order to accommodate in particular rotating or reciprocating working movements. In practice, there are also tools for fine machining of surfaces with a substantially triangular basic shape, for example, that are used for eccentric mixed movements on a surface to be machined, for example.

The specification incorporates by reference the entire disclosure of German priority document 20 2014 000 852.3 having a filing date of Jan. 30, 2014.

While specific embodiments of the invention have been shown and described in detail to illustrate the inventive principles, it will be understood that the invention may be embodied otherwise without departing from such principles.

What is claimed is:

1. A tool for fine machining of surfaces, the tool comprising:

a working medium carrier comprising a bottom side and a top side and further comprising grooves, wherein the grooves extend from the top side to the bottom side completely through the working medium carrier and comprise a narrowed portion at the bottom side but do not narrow in upward direction toward the top side, respectively;

the working medium carrier comprised of an injection-molded plastic part;

lamellas each comprising a holding rim and a lamella body connected to the holding rim;

the lamellas inserted with the holding rim in the grooves, respectively, such that the lamella body of the lamellas extends downwardly away from the holding rim, passes through the narrowed portion, and extends away from the bottom side of the working medium carrier;

the lamellas arranged so as to be uniformly distributed about the bottom side of the working medium carrier;

the grooves each comprising an open end in a longitudinal direction of the grooves at a carrier rim of the working medium carrier, wherein the open end has a cross-section matching a cross-section of the grooves;

a cover fixedly connected to the top side of the working medium carrier and covering the grooves at the top side of the working medium carrier and the holding rim of the lamellas.

2. The tool according to claim 1, wherein the cover engages across the carrier rim of the working medium carrier, wherein the open end of the grooves is located at the carrier rim and the cover at least partially closes off the open end of the grooves.

3. The tool according to claim 1, wherein the cover engages the holding rim of the lamellas within the grooves.

4. The tool according to claim 1, wherein the working medium carrier comprises suction channels extending from suction openings distributed across the bottom side in upward direction completely through the working medium carrier, wherein the cover covers at the top side at least partially the suction channels.

5. The tool according to claim 1, wherein the working medium carrier is circular and the grooves extend radially.

6. The tool according to claim 5, wherein the working medium carrier has a central area and the grooves include first grooves and second grooves, wherein the first grooves are longer than the second grooves and end closer to the central area than the second grooves, wherein the first and second grooves are arranged alternatingly in a circumferential direction about the central area.

7. The tool according to claim 1, wherein the bottom side of the working medium carrier is convexly shaped and the lamellas have a curved strip shape.

8. The tool according to claim 1, further comprising a drive connector, wherein the working medium carrier is connected directly with the drive connector.

9. The tool according to claim 1, wherein the cover is detachably connected to the working medium carrier by a screw connection or a locking action.

10. The tool according to claim 9, wherein the cover and the working medium carrier each have an annular surface and the annular surfaces are coaxially arranged relative to each other, wherein the screw connection is realized between the annular surfaces.

11. The tool according to claim 10, wherein the working medium carrier comprises a drive connector and the drive connector passes through the cover in an upward direction, wherein the annular surface of the working medium carrier is located on the drive connector and the screw connection is realized between the cover and the drive connector.

12. The tool according to claim 1, wherein the cover is a cap with a closed top, wherein the closed top comprises a grip area, wherein the cover engages across the working medium carrier.

13. The tool according to claim 12, wherein the cover is provided with a grip in the grip area.

14. The tool according to claim 12, wherein the cover comprises a hand loop for inserting a hand.

15. The tool according to claim 14, wherein the hand loop is comprised of two loop pieces that are adapted to move opposite relative to each other for a width adjustment of the hand loop.

* * * * *